United States Patent [19]

Brar

[11] Patent Number: 4,486,101

[45] Date of Patent: Dec. 4, 1984

[54] APPARATUS FOR BLENDING PARTICULATE MATERIALS

[76] Inventor: Gurdarshan S. Brar, 8906 Cher Ct., Houston, Tex. 77040

[21] Appl. No.: 493,058

[22] Filed: May 9, 1983

[51] Int. Cl.[3] ..... B01F 13/02

[52] U.S. Cl. ..... 366/101; 137/625.41; 222/195; 406/129

[58] Field of Search ..... 366/101, 106, 107, 136, 366/137, 341, 262, 266, 270, 21, 160, 181, 193; 222/195, 547, 564; 406/129, 133, 136, 137, 138; 137/625.41, 874, 876

[56] References Cited

U.S. PATENT DOCUMENTS

| | | | |
|---|---|---|---|
| 2,718,435 | 9/1955 | Hudspeth | 406/133 X |
| 2,806,744 | 9/1957 | Hall et al. | 366/101 X |
| 2,907,501 | 10/1959 | Laird | 222/564 X |
| 3,276,753 | 10/1966 | Solt et al. | 366/107 |
| 4,194,845 | 3/1980 | Krambrock et al. | 366/101 X |

FOREIGN PATENT DOCUMENTS

| | | | |
|---|---|---|---|
| 2922580 | 12/1980 | Fed. Rep. of Germany | 137/625.41 |
| 2058700 | 4/1981 | United Kingdom | 406/133 |

*Primary Examiner*—Philip R. Coe

*Attorney, Agent, or Firm*—Bill B. Berryhill

[57] ABSTRACT

Particulate blending apparatus including a vessel, the lower end of which is a downwardly tapered funnel-like section. A vertical divider divides the tapered section into first and second compartments. A vertical tubular member is centrally disposed in the vessel so that the lower end thereof provides an inlet into the vessel and the upper end opens into the upper portion of the vessel. First and second openings are provided on opposite sides of the vertical tubular member at the lower end thereof through which particulate materials may flow by gravity into the tubular member from the first and second compartments, respectively, of the tapered section. A blower may be connected to the lower end of the tubular member providing a stream of air therethrough by which particulate materials entering the tubular member through the first and second openings may be entrained therewith exiting through the upper end of the tubular member for redeposition in the vessel. Valve assembly may be provided by which the flow area of the first and second openings may be varied so that the mass flow of particulate materials from the first compartment may be substantially different than the mass flow of particulate materials from the second compartment.

10 Claims, 6 Drawing Figures

APPARATUS FOR BLENDING PARTICULATE MATERIALS

BACKGROUND OF THE INVENTION

1. Field of the Invention

The present invention pertains to apparatus for blending particulate materials. Specifically, it pertains to apparatus for the mixing and blending of small solid particulate matter utilizing at least to some extent, gravity.

2. Description of the Prior Art

There are many different kinds of gravity blenders which are utilized for the mixing and blending of powder and granular materials or other particulates such as plastic pellets. Examples of such may be seen in U.S. Pat. Nos. 3,647,188; 3,871,626; 4,002,325; 4,128,343; and 4,285,602.

In most of these gravity-type blenders, a vessel is provided for holding the materials to be mixed or blended. Conduits or pipes of some type are normally provided in the vessel for communication with a stream of air or other gas provided by a blower or the like. The materials to be mixed or blended are introduced into the air stream provided by the blower at the lower end of the conduit and conveyed to the upper portion of the vessel through the conduit for recirculation therein. Various means are provided for introducing the materials into the conduit and various types of conduits have been designed. It is generally conceded that a minimum number of three material turnovers is necessary to arrive at an appropriate random mixture. A complete random mixture is essential in some operations such as the plastic manufacturing business to achieve the quality required.

Some of the gravity blenders of the prior art, such as the one shown in U.S. Pat. No. 4,285,602, utilize excessive lengths of conveying conduits and bends. Some also have excessive horizontal sections or support members. Such characteristics require high air and particle velocities and also result in excessive pressure drop in the conveying system. This, of course, requires more expensive equipment and greater energy cost. In addition, particularly with blending of plastic pellets and the like, high velocity causes wear on the particles and excessive build-up of the material on the conduits and bends and supporting members. Blenders which utilize external circulation require a greater number of material turnovers to arrive at a proper mixture.

To avoid some of the above-mentioned disadvantages of external conveying pipe, internal recirculation blenders have been developed such as those cited herein. Most of these internal circulation gravity blenders utilize a central conveying tube into which the material to be blended is metered by annular gaps therearound. In U.S. Pat. No. 3,871,626, the width of the annular gap is, to some degree, variable. However, the internal components of such a blender are relatively complex, resulting in high manufacturing cost. Furthermore, it is difficult to convert existing silos or vessels into blenders utilizing such characteristics.

SUMMARY OF THE INVENTION

The present invention includes a vessel, the lower end of which is a downwardly tapered funnel-like section. A vertical divider divides the tapered section into first and second compartments. A vertical tubular member is centrally disposed in the vessel so that the lower end thereof provides an inlet into the vessel and the upper end opens into the upper portion of the vessel. First and second openings are provided on opposite sides of the vertical tubular member at the lower end thereof through which particulate materials may flow by gravity into the tubular member from the first and second compartments, respectively, of the tapered section. A blower may be connected to the lower end of the tubular member providing a stream of air therethrough by which particulate materials entering the tubular emmber through the first and second openings may be entrained therewith exiting through the upper end of the tubular member for redeposition in the vessel.

A valve assembly may be provided by which the flow area of the first and second openings may be varied so that the mass flow of particulate materials from the first compartment may be substantially different than the mass flow of particulate materials from the second compartment. Because the mass flows from these two compartments are different, the sedimentation velocity on one side of the vessel is different than on the other. Adjustment of the openings is simple and minimizes blending time due to the shearing effect between the differing sedimentation velocities in the vessel.

Even though the blending characteristics of the apparatus of the present invention are superior to the gravity blenders of the prior art, the components thereof are not more complex. In fact, they are less complex than most gravity blenders. This results in reduced manufacturing and operational cost. In addition, existing silos and vessels may be easily converted to an embodiment of the present invention. Many other objects and advantages of the invention will be apparent from the description which follows in conjunction with the accompanying drawings.

DESCRIPTION OF PREFERRED EMBODIMENTS

Figure 1:
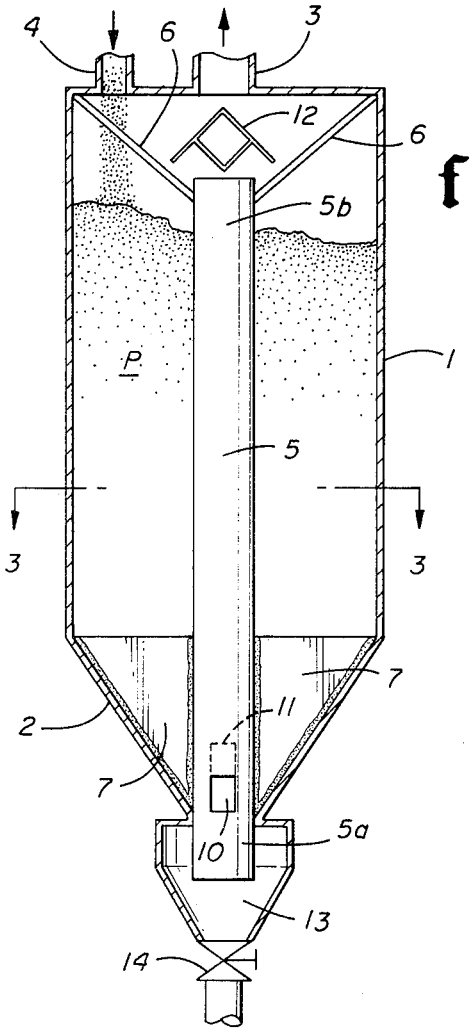
FIG. 1 is a side elevation view, partially in section, of particulate blending apparatus, according to a preferred embodiment of the invention.

Referring first to FIG. 1, the blending apparatus of the present invention includes a vessel (cylindrical in the exemplary embodiment) having a vertical axis and the lower end of which is a downwardly tapered funnel-like section 2. In the exemplary embodiment the lower end 2 is actually defined by an inverted frusto-conical section. The vessel 1 may be closed at its upper end and provided with an outlet 3 and a filling inlet 4.

Centrally disposed in the vessel 1 is a vertical tubular member 5, the lower end 5a of which provides an inlet into the vessel 1 and the upper end 5b of which opens into the upper portion of the vessel 1. The tubular member 5 may actually be welded or joined in some other fashion at the lower end of the tapered section 5. The tubular member 5 may be supported at its upper end by radial support members or rods 6.

Figure 2:
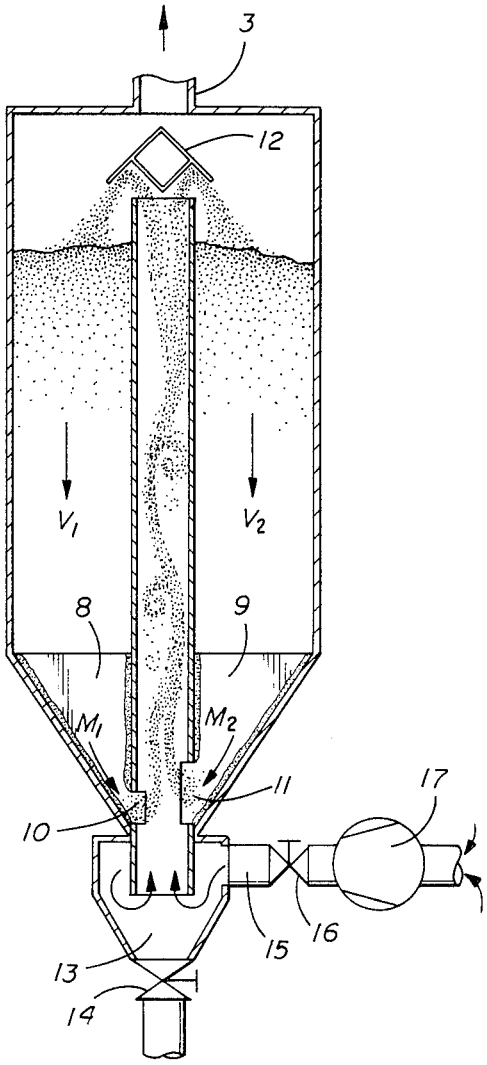
FIG. 2 is a side elevation view, partially in section, of the particulate blending apparatus of FIG. 1, rotated ninety degrees about its vertical axis.
Figure 3:
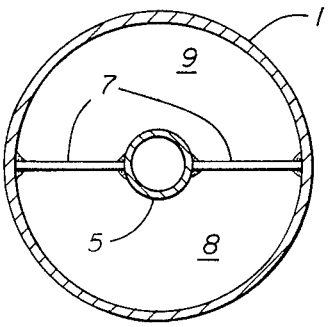
FIG. 3 is a cross-sectional view of the particulate blending apparatus of the present invention taken along line 3—3 of FIG. 1.

It will be noted that vertical divider plates 7 are provided in the tapered section 2 axially dividing the tapered section into first and second compartments 8 and 9 as best seen in FIGS. 2 and 3. First and second openings 10 and 11 are provided on opposite sides of the tubular member 5 within the frusto-conical section. These openings 10 and 11 allow particulate materials to flow by gravity from the first and second compartments 8 and 9, respectively, into the tubular member 5. Adjustable means may be provided for adjusting the effective areas of the first and second openings 10 and 11 so that the mass flow of particulate materials $M_1$ and $M_2$ from the first and second compartments 8 and 9, respectively, may be substantially different. There are any number of means for adjusting the effective areas of the first and second openings 10 and 11, one such embodiment being described hereafter with reference to FIGS. 4–6.

Centrally disposed in the upper portion of the vessel 1, above the upper end of the tubular member 5, is a deflecting member 12. The deflecting member 12 may be designed in any fashion so that when mixtures of solids and air or other gases are inpinged thereagainst in an upwardly direction through the tubular member 5, the solids are deflected back into the vessel 1 while the air and other gases exit through the outlet 3.

Directly below the lower end of the tubular member 5 is a chamber 13 below which is a valve 14. Connected to one side of the chamber through a conduit 15 and valve 16 is a blower 17. It will be understood that with the valve 16 open and the blower 17 operated, air or other gases may be introduced into the lower end 5a of the tubular member 5 through conduit 15 and the chamber 13. This provides an air stream through the tubular member 5 by which particulate materials entering the tubular member through the first and second openings 10 and 11 may be entrained therewith for exiting through the upper end of the tubular member 5 against the deflector means 12 for redeposition in the vessel 1.

Figure 4:
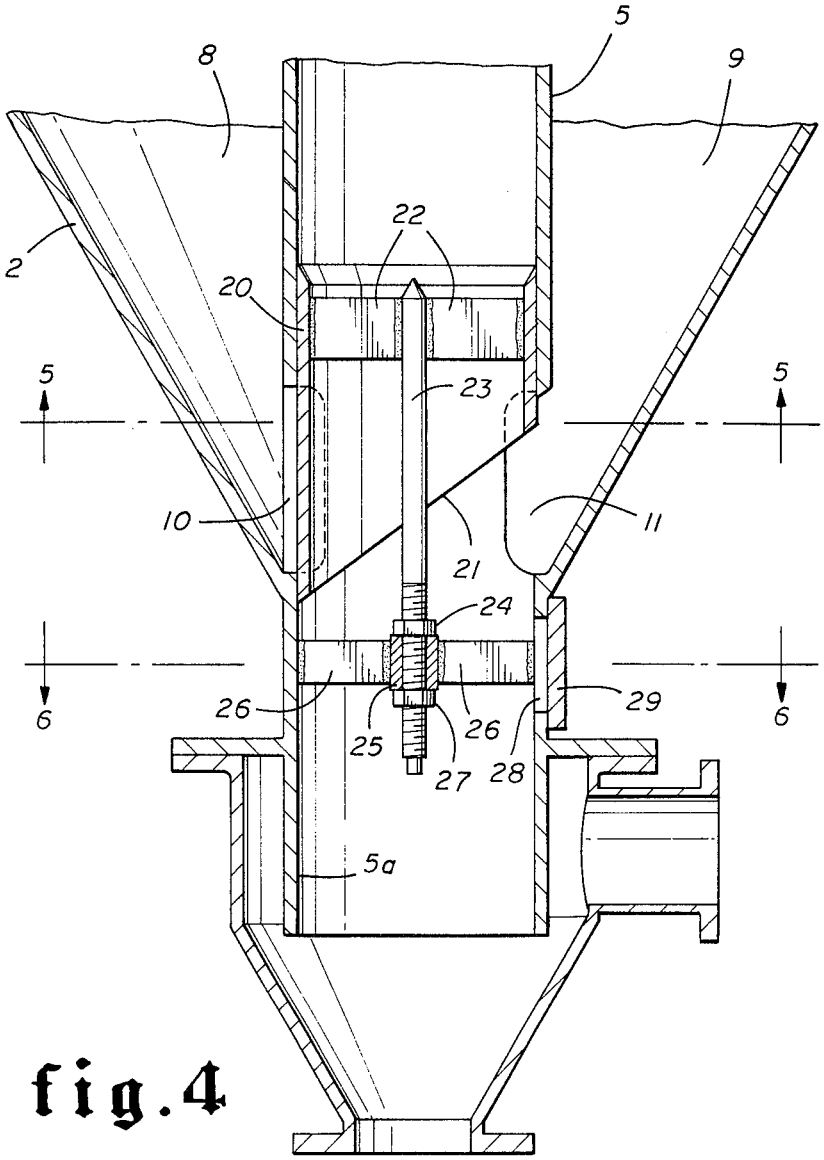
FIG. 4 is a detailed sectional view of the lower portion of the particulate blending apparatus of the present invention.
Figure 5:
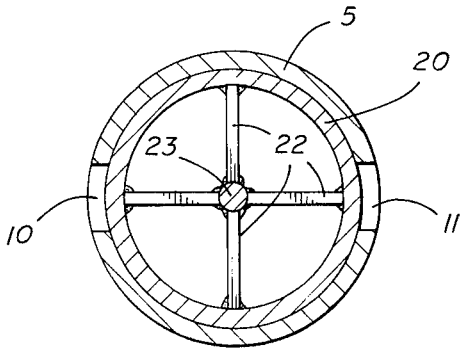
FIg. 5 is a cross-sectional view of the lower portion of the blending apparatus of the present invention taken along line 5—5 of FIG. 4.
Figure 6:
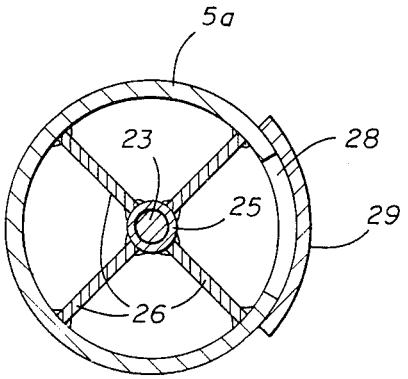
FIG. 6 is a cross-sectional view of the blending apparatus of the present invention taken along line 6—6 of FIG. 4.

Referring now to FIGS. 4, 5, and 6, a particular embodiment of the valve means by which the effective flow areas of openings 10 and 11 can be adjusted will be described. This particular valve includes a tubular sleeve 20 which is slidingly and rotatingly disposed within the tubular member 5 near the lower end thereof. The end 21 of the sleeve 20 is cut on a bias with the axis thereof. Thus, it can be understood that by rotating and/or moving the sleeve 20 axially, the effective flow areas of the openings 10 and 11 can be adjusted from completely closed positions (as shown with opening 10 in FIG. 4) to completely open positions and anywhere in between.

The sleeve can be supported in any suitable manner. In an exemplary embodiment, it is supported by radial support members 22 attached to a central rod 23. The rod may be threaded and provided with a nut 24 by which the rod and sleeve 20 may be supported on a bushing 25 which is in turn supported by radial support member 26 in the tubular member 5. Another nut 27 may be provided below the bushing 25. Nuts 24 and 27 may be manipulated so as to position the sleeve 20 in any axial or rotational position desired. To provide access to the nuts 24 and 27, an access passageway 28 and cover 29 may be provided in the tubular member 5.

STATEMENT OF OPERATION

Referring now to all the drawings, but particularly FIGS. 1–3, the operation of the blending apparatus of the present invention will be described. After the vessel 1 has been filled through inlet 4 with the particulate material P to be mixed and blended, the blower 17 is actuated producing a stream of air upwardly through the tubular member 5. With the areas of the openings 10 and 11 adjusted for the desired flow, the particulate materials from the first and second compartments 8 and 9 are allowed to flow by gravity into the tubular member 5 through the openings 10 and 11, mass flow being indicated at $M_1$ and $M_2$. Because these mass flows are different, the sedimentation velocities $V_1$ and $V_2$ are also different. The shearing effect created between the difference in velocities $V_1$ and $V_2$ minimize the blending time. As the particulates flow into the tubular member 5 they are entrained in the air stream and travel therewith upwardly through the tube toward the deflector 12. At the deflector 12 the solid particulate materials are redirected for redeposition into the vessel 1 and the air or other gases allowed to escape through the outlet 3.

After the materials in the vessel 1 are properly blended, the blower 17 can be deactivated and the properly blended materials removed by gravity flow through the valve 14 for further use or processing. After the vessel is emptied, the valve 14 can be closed and the blending process repeated, the vessel 1 being refilled through the inlet 4.

CONCLUSION

The blending apparatus of the present invention is superior to the blending apparatus of the prior art in many respects. Shorter blending time is required, less costly equipment is required because of reduced velocities and pressure drops. The apparatus is very simple and inexpensive to manufacture. It is also easily adapted to existing silos or vessels.

Although a single embodiment has been described herein, many other embodiments are possible. For example, many types of valve assemblies can be designed for varying the effective flow areas of the openings 10 and 11. In addition, the tubular member 5 may be made in two or more telescoping sections independently supported so as to allow axial displacement of one section relative to the other. Such construction would allow for expansion and contraction due to changes in temperature and would also allow for universal mounting in silos or vessels of varying heights. Many other variations can be made by those skilled in the art without departing from the spirit of the invention. Accordingly, it is intended that the scope of the invention be limited only the the claims which follow.

I claim:

1. Apparatus for blending particulate materials comprising:

a vessel having a lower end which is a downwardly tapered funnel-like section and an upper end which is provided with an outlet;

vertical tubular means centrally disposed in said vessel having a lower end which provides an inlet into said vessel and an upper end which opens into an upper portion of said vessel;

vertical divider means dividing said tapered second into first and second compartments;

first and second openings provided on opposite sides of said vertical tubular means near said lower end thereof and through which particulate materials may flow by gravity into said tubular means from said first and second compartments, respectively;

adjustable valve means disposed in said lower end of said tubular means by which the flow area of at least one of said first and second openings may be varied so that the mass flow of particulate materials from said first compartment through said first opening may be substantially different than the mass flow of particulate materials from said second compartment through said second opening; and blower means connected to said lower end of said tubular means providing a stream of air through said tubular means by which particulate materials entering said tubular means through said first and second openings may be entrained therewith exiting through said upper end of said tubular means for redeposition in said vessel.

2. Apparatus as set forth in claim 1 including deflecting means disposed in said vessel above said upper end of said tubular means by which said particulate materials in said stream of air may be deflected for said redeposition in said vessel.

3. Apparatus as set forth in claim 1 in which said valve means comprises a tubular sleeve slidingly disposed within said tubular member and adjustable therein to cover varying areas of said first and second openings.

4. Apparatus as set forth in claim 3 in which one end of said tubular sleeve is formed by cutting the end thereof on a bias with the axis thereof.

5. Apparatus as set forth in claim 3 in which said valve means comprises a rod centrally disposed in said tubular sleeve and attached thereto by radial support members, one end of said rod being supported by other radial support members attached to said vertical tubular member.

6. Apparatus as set forth in claim 5 in which said tubular sleeve is rotatingly and axially adjustable by rotation and axial adjustment of said rod relative to said other radial support members.

7. Apparatus as set forth in claim 6 including a closable access way in the walls of said tubular member which, when opened, allows access to said rod for said rotating and axial adjustment of said rod.

8. Apparatus for blending particulate materials comprising:

a cylindrical vessel having a vertical axis and a lower end which is defined by an inverted frusto-conical section;

a vertical tubular member centrally disposed in said vessel and sealingly joined thereto at the lowermost portion of said frusto-conical section, a lower end of said tubular member providing an inlet into said vessel, an upper end of said tubular member opening into an upper portion of said cylindrical vessel;

vertical divider means dividing said frusto-conical section into first and second compartments;

first and second openings provided on opposite sides of said tubular member within said frusto-conical section and through which particulate materials may flow by gravity from said first and second compartments, respectively, the effective areas of said first and second openings being adjustable so that the mass flow of particulate materials from said first and second compartments through said first and second openings, respectively, may be substantially different; and means for introducing an air stream into said lower end of said tubular member by which particulate materials entering said tubular member through said first and second openings may be entrained, exiting said upper end of said tubular member for redeposition in said vessel.

9. Apparatus as set forth in claim 8 including deflecting means disposed in said vessel above said upper end of said tubular member by which said particulate materials in said stream of air may be deflected for said redeposition in said vessel.

10. Apparatus as set forth in claim 9 including an outlet in an upper end of said vessel through which air separated from said particulate materials by said deflecting means may exit said vessel.

* * * * *

UNITED STATES PATENT OFFICE

CERTIFICATE OF CORRECTION

Patent No. 4,486,101 Dated December 4, 1984

Inventor(s) Gurdarshan S. Brar

It is certified that error appears in the above-identified patent and that said Letters Patent are hereby corrected as shown below:

Column 5, line 1, change "second" to -- section --.

Signed and Sealed this

*Twenty-third* Day of *April 1985*

[SEAL]

*Attest:*

DONALD J. QUIGG

*Attesting Officer* *Acting Commissioner of Patents and Trademarks*